United States Patent [19]

Quest

[11] Patent Number: 5,022,621

[45] Date of Patent: Jun. 11, 1991

[54] MULTI-HOOKS BRACKET FOR CANTILEVERLY SUPPORTING OFFICE EQUIPMENT

[76] Inventor: Thomas A. Quest, 906 S.117th Ct., Omaha, Nebr. 68154

[21] Appl. No.: 521,025

[22] Filed: May 9, 1990

[51] Int. Cl.[5] ..... A47B 57/00

[52] U.S. Cl. ..... 248/225.2; 248/243; 248/222.1

[58] Field of Search ..... 248/225.2, 243, 250, 248/221.2, 220.4, 222.1, 223.3; 211/187, 193; 108/106, 107, 108, 152, 144, 146

[56] References Cited

U.S. PATENT DOCUMENTS

| | | | |
|---|---|---|---|
| 2,127,280 | 8/1938 | Zimbalist | 248/243 |
| 2,312,985 | 3/1943 | Bales | 248/221.2 |
| 3,353,684 | 11/1967 | Chesley | 248/243 X |
| 3,601,432 | 8/1971 | Fenwick | 248/243 X |
| 4,324,379 | 4/1982 | Ovitz, III | 248/243 X |
| 4,387,872 | 6/1983 | Hogue | 248/221.3 |

FOREIGN PATENT DOCUMENTS

| | | | |
|---|---|---|---|
| 1188778 | 3/1965 | Fed. Rep. of Germany | 248/243 |
| 1361087 | 7/1974 | United Kingdom | 248/222.1 |

*Primary Examiner*—Karen J. Chotkowski
*Attorney, Agent, or Firm*—George Nimmer

[57] ABSTRACT

Writing desks and other office equipment are commonly cantileverly supported upon arm-like multi-hooks brackets, the bracket being hookably attached within vertically spaced and vertically elongated apertures of an upright column. Inasmuch as a bracket hooked portion can only partially occupy the height of a column aperture, accidental upward bumping of the bracket can dislodge it from the upright column thus endangering the cantileverly supported office equipment. The multi-hooks bracket described herein is provided with a notchably serrated type lock that cooperates with a bracket hook to effectively together occupy the entire height of a column aperture, so that the bracket is made resistive to accidentally imparted upward forces. The multi-hooks bracket disclosed herein is preferably singularly constructed, and along distinctly different upright planes, of a laminar structural material, such construction providing an unusually strong and economical cantilever support for office equipment.

4 Claims, 2 Drawing Sheets

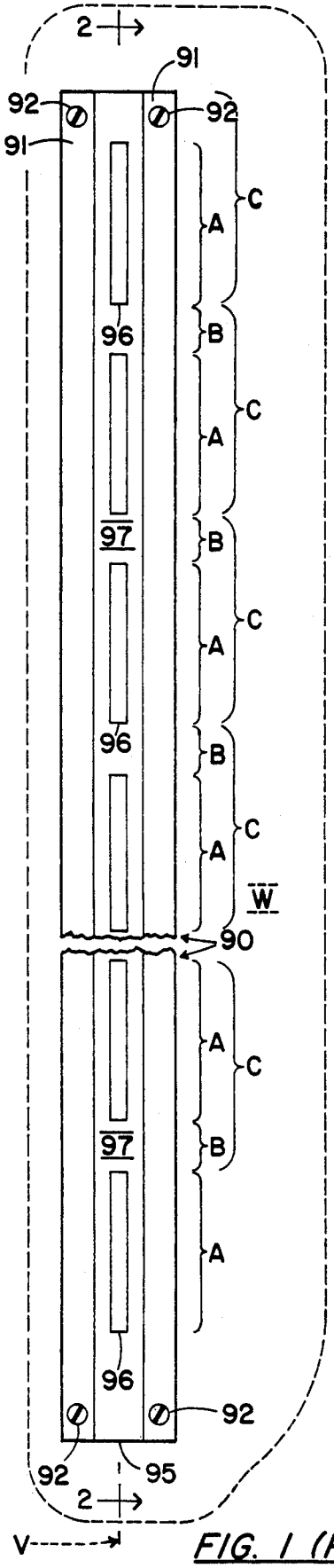
FIG. 1 (PRIOR ART)
FIG. 2 (PRIOR ART)
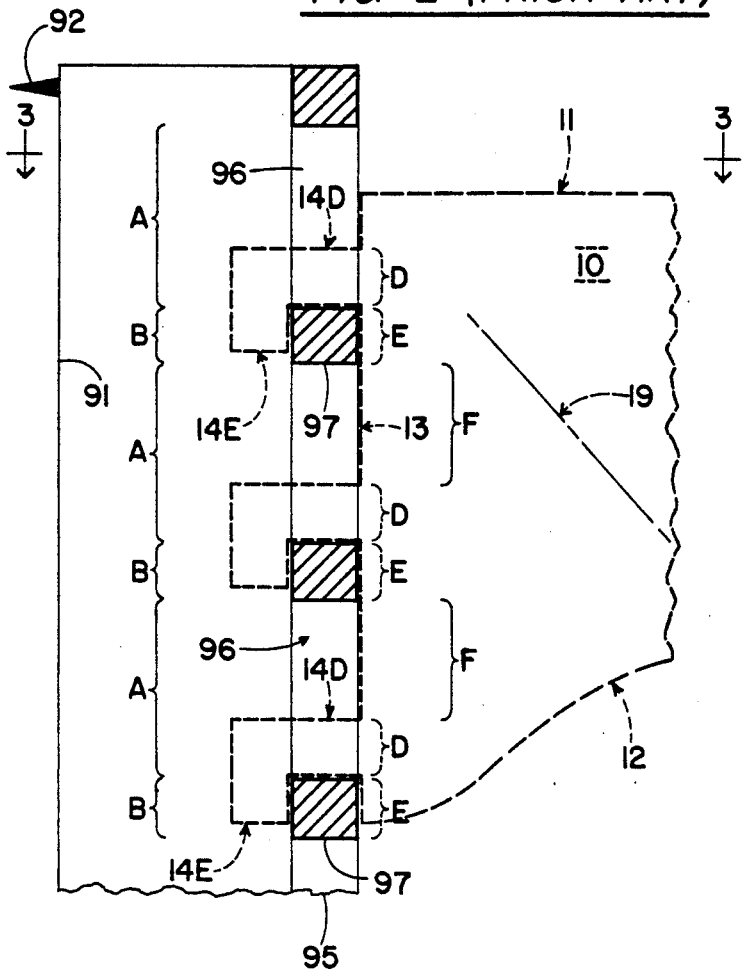
FIG. 3 (PRIOR ART)
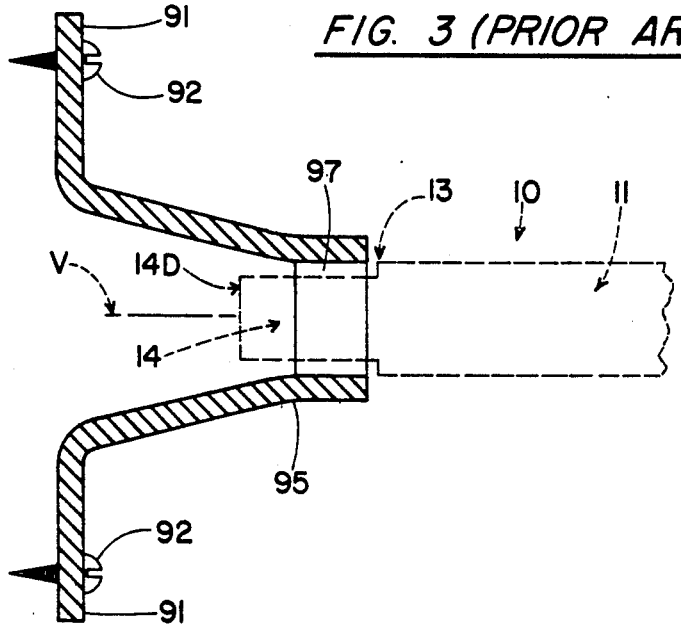

FIG. 4
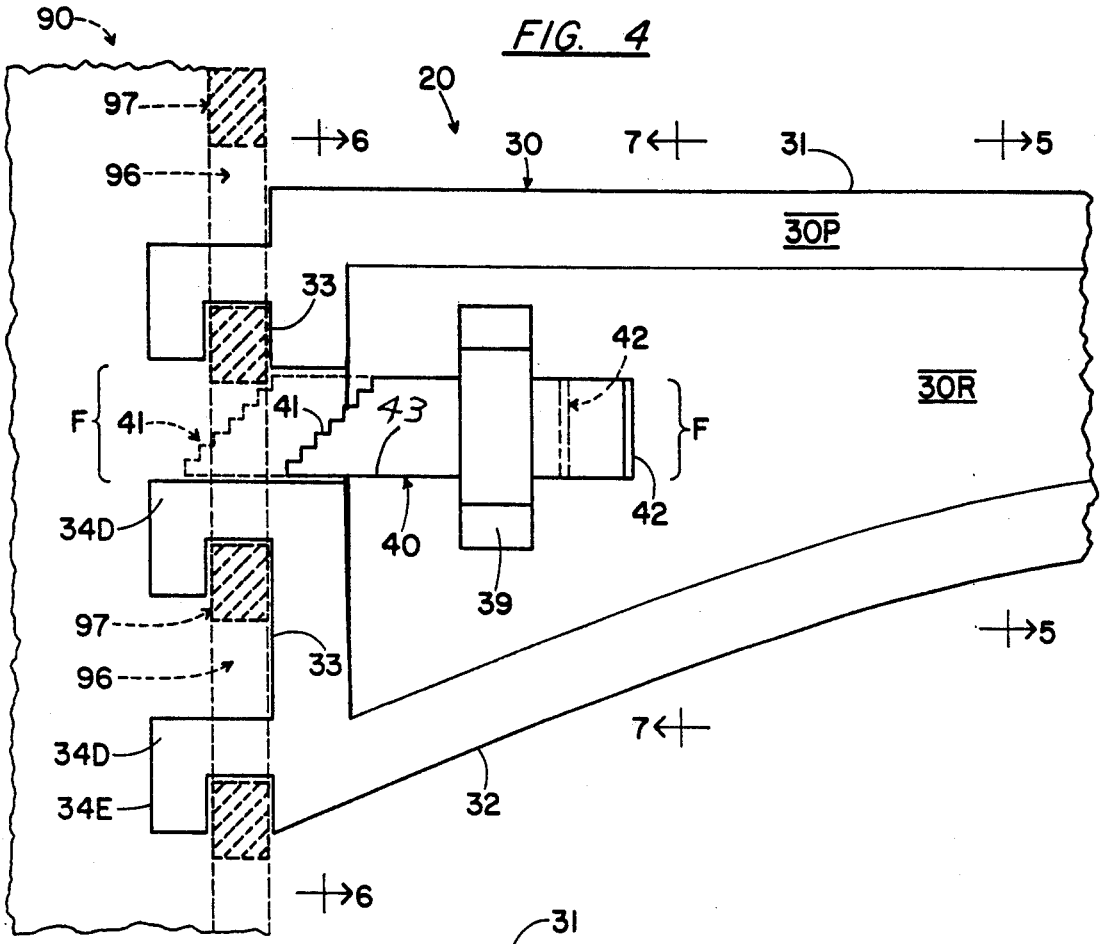
FIG. 7
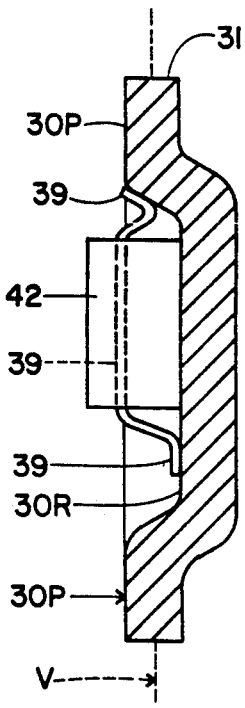
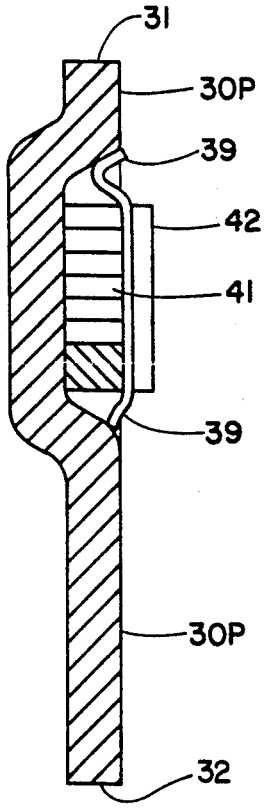
FIG. 6
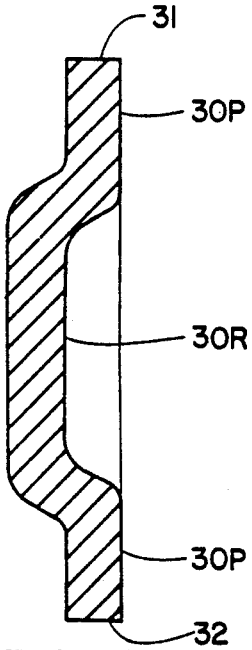
FIG. 5

MULTI-HOOKS BRACKET FOR CANTILEVERLY SUPPORTING OFFICE EQUIPMENT

BACKGROUND OF THE INVENTION

As will be more particularly described in connection with drawing FIGS. 1-3, it is well known that writing desks and other office equipment might be cantileverly supported upon arm-like multi-hooks brackets, the bracket being removably (and ostensibly securely) hookably attached within vertically spaced and vertically elongated apertures of an upright column. Inasmuch as the respective hooks of such removably hookably attached brackets can only partially occupy the height of a column aperture, accidental upward bumping of the bracket is apt to dislodge it from the upright column, thus endangering the cantileverly supported office equipment. In view of the heavy office equipment to be cantileverly supported thereby, prior art workers have traditionally relied upon complicated, heavy, and accordingly expensive, constructions for the multi-hooks bracket cantilever support.

OBJECT OF THE INVENTION

In view of the foregoing, it is an objective of the present invention to provide a multi-hooks bracket that is removably hookably attachable to various multi-apertured columns, the removably hookably attached bracket being resistant to being dislodged from the column whenever accidental upward forces are imparted thereto. It is another objective to provide a multi-hooks bracket that is sufficiently structurally strong to cantileverly support heavy office equipment but which sufficient structural strength is provided in surprisingly economical fashion.

GENERAL STATEMENT OF THE INVENTION

With the above general objectives in view, and together with other ancillary and specific objectives which will become more apparent as this description proceeds, the multi-hooks bracket of the present invention comprises a lock device that is horizontally reciprocatably associated with the arm-like bracket and that spatially cooperates with a bracket hook to effectively occupy the entire height of a column aperture so that the hookably attached bracket is made resistive to accidentally imparted upward forces, the reciprocatable lock being provided with a notchably serrated rear-end contour that enables the lock and the adjacent bracket hook to cooperatively fully occupy the specifically encountered column aperture height, and the bracket arm being preferably singularly laminarly constructed along two distinct upright planes which provides an exceptionally strong and economical cantilever support and which structure facilitates mounting of the horizontally reciprocatable lock.

BRIEF DESCRIPTION OF THE DRAWINGS

In the drawing, wherein like characters refer to like parts in the several views, and in which:

FIG. 1 is a frontal elevational view of a representative upright multi-apertured column (90) which in the prior art is employed for supporting multi-hooks brackets;

FIG. 2 is a sectional elevational view taken along line 2—2 of FIG. 1, the column (90) being depicted in solid lines and a hookably engaged multi-hooks bracket (10) being depicted in phantom lines;

FIG. 3 is a sectional plan view taken along line 3—3 of FIG. 2, the column (90) being depicted in solid lines and the typican prior art bracket (10) being depicted in phantom lines;

FIG. 4 is a side elevational view, analagous to FIG. 2, showing a representative embodiment (20) of the multi-hooks bracket of the present invention, the bracket being depicted in solid lines and the environmental column (90) being depicted in phantom lines;

FIG. 5 is a sectional elevational view taken along line 5—5 of FIG. 4;

FIG. 6 is a sectional elevational view taken along line 6—6 of FIG. 4;

FIG. 7 is a sectional elevational view taken along line 7—7 of FIG. 4.

DETAILED DESCRIPTION OF THE DRAWING

Drawing FIGS. 1-3 depict a prior art multi-hooks bracket (10) adapted to hookably attach (14) into vertically spaced and vertically elongated apertures (96) of a prior art multi-apertured column (90) whereby said hookably attached bracket is adapted to cantileverly support office equipment.

A representative multi-apertured column 90 of the prior art comprises a pair of uprightly co-planar and laterally outwardly extending flanges 91 adapted to abut an upright environment (e.g. wall "W"); screws 92 passing through flanges 91 are employable to effect attachment of column 90 to a wall or other upright environment. Between flanges 91 and extending directionally longitudinally therefrom, representative column 90 includes a forwardly extending central portion which, along an upright and directionally longitudinal first-plane "V", is provided with regularly vertically spaced (97) and vertically elongated apertures 96. The regular vertically elongated height of each aperture 96 is of a manufacturer-selected arbitrary value "A", and the regular non-apertured spacing 97 is of manufacter-selected arbitrary value "B". Though dimensional values "A" and "B" differ among column manufacturers, nearly all manufacturers utilize a one-inch value "C" for the recurring sums of "A" and "B".

A representative multi-hooks bracket 10 of the office equipment prior art comprises a generally horizontally extending arm member having a periphery that includes: a generally horizontal and directionally longitudinal upper-edge 11 adapted to support office equipment thereat; a lower-edge 12; and an upright rear-side 13. Arm rear-side 13 is provided with a plurality of hooks 14 arrayed along said upright first-plane "V". Each hook 14 comprises a horizontally rearwardly extending portion 14 D (having the same heights "D") and also comprises a downward portion 14E (having the same heights "E"). Inasmuch as the sum of heights "D" and "E" is empirically selected to not exceed aperture height "A", each hook 14 is insertable through a column aperture 96 so that hook first portions 14D downwardly rest upon column non-apertured portions 97 and that hook second portions 14E abut said non-apertured portions 97. Accordingly, the hook's horizontal portion height "D" only partially occupies the aperture height "A", the hook's non-occupied aperture portion being arithmetically computable as "A minus D", or "F". As previously alluded to, the exact arithmetic value for "F" is variable and primarily dependent upon the manufacturer-selected values "A" and "B" for the upright column (90). In view of the hooks' non-occupied portions "F", accidental upward bumping to an arm at 12 is likely to dislodge the arm-type bracket from the multi-hooks engagement with the column (90).

Line 19 in FIG. 2 refers to a locus-of-stress, likely to be exhibited as bracket fracture, whenever the hookably-attached bracket (10) is too heavily cantileverly loaded with office equipment.

Turning now to drawing FIGS. 4–7 which depict a representative embodiment 20 of the improved multi-hooks bracket of the present invention and that comprises an upright and directionally longitudinally extending arm member 30 equipped with a horizontally reciprocatable lock 40 for plugging-into a hook's non-occupied aperture portion "F".

Bracket arm member 30 has a periphery that comprises a directionally longitudinally extending horizontal upper-edge 31 adapted to support office equipment thereat, a lower-edge 32, and an upright rear-side 33 equipped with rearwardly extending hooks 34 arrayed along vertical first-plane "V". As in prior art structure 10, each hook comprises a horizontally rearwardly extending portion 34D (having the same empirically selected heights "D") that is downwardly restable upon a column non-apertured portion 97, and also comprises a downward portion 34E (having the same empirically selected heights "E") that is forwardly abuttable against portion 97. And, as in the prior art, each hook's horizontal portion height "D" only partially occupies column aperture height "A". In order to ecomomically and effectively confront the fracture problem (19) previously alluded to, it is preferable that the periphery (e.g. 31–34) of arm 30 lies along said upright first-plane "V". However, the arm central portion 30R lies along an upright second-plane that is directionally laterally offset from and parallel to first-plane "V", and both planes 30P and 30R of arm 30 are together singularly constructed of the same laminar metallic structural material.

Bracket lock member 40 might take the form of a horizontally extending flat plate that lies along first-plane "V" and that is positioned at arm rear-side 33 at an elevation between consecutive hooks 34. In the latter regard, the horizontal lower-side 43 of locking plate 40 is preferably at an elevation equivalent to the horizontal upper-side of a hook horizontal portion 34D. Horizontally reciprocatable engagement between lock plate 40 and arm 30 is herein provided by means of an upright strap 39 that is welded or otherwise attached to arm 30. For the preferred dual-planes unitary arm 30P–30R, there is a slidable relationship between horizontally reciprocatable lock plate 40 and arm central portion 30R. Lock plate 40 is herein provided with a frontal tab 42 for manually effecting lock plate horizontal reciprocation.

This invention's intention is that the horizontally reciprocatable lock 40 will plug-into the unoccupied vertical height "F" of a column aperture 96 whereby the bracket 20 is made resistant to being dislodged from hooked engagement with the column (90) whenever the bracket is accidentally upwardly bumped. Frustrating this intention is the previously recited fact that the unoccupied vertical height "F" is affected by the manufacturer-selected empirical height "A" for the column apertures 96, whereby the dimensional value for "F" is variable. Among the five currently leading manufacturers of multi-apertured columns (90), and assuming a constant 0.250 inch height value for "D", the values "F" influenced by the five currently leading column manufacturers are: 0.500 inch; 0.385 inch; 0.330 inch; 0.280 inch; and 0.250 inch. Accordingly, to ensure lock "plug-in" into aperture unoccupied height "F" of an arbitrarily confronted column, lock plate 40 is provided with a notchably-serrated upwardly-forwardly inclined rear-end contour 41. The exact number of notched serrations for lock rear-end 41 is equal to the number of column manufacturers to be conformed to. Since two column manufacturers are pre-eminent, and these two along with three or four others dominate the market, the number of notched serrations at the lock inclined rear-end 41 is at least two but not more than six in number. Thus, and as alluded to hereabove, the heights of successive notches above locking plate lower-side 43 might appropriately take the previously recited values of: 0.500 inch; 0.385 inch; 0.330 inch; 0.280 inch; and 0.250 inch.

In order to ensure that the lock's notchably-serrated rearend 41 will not stray from its column plug-in mode, the improved bracket of the present invention might be provided with anti-straying means. Such anti-straying means might take the depicted form of said strap 39 tightly frictionally engaging locking bar 40, or alternatively, pawl-and-ratchet, set-screw, and/or equivalent means actuatably extending between the locking bar and the arm portions of the improved bracket.

From the foregoing, the construction and operation of the multi-hooks bracket will be readily understood and further explanation is believed to be unnecessary. However, since numerous modifications and changes will readily occur to those skilled in the art, it is not desired to limit the invention to the exact construction shown and described, and accordingly, all suitable modifications and equivalents may be resorted to, falling within the scope of the appended claims.

I claim:

1. For a multi-hooks bracket adapted to hookably attach into vertically spaced and vertically elongated apertures of a multi-apertured column whereby the hookably attached bracket is adapted to cantileverly support office equipment, an improved multi-hooks bracket structure that is resistant to upward dislodgement from the multi-apertured column, said improved bracket structure comprising:

(A) a generally horizontally extending arm having a periphery comprising a substantially horizontally upper-edge adapted to support office equipment thereat and also comprising an upright rear-side;

(B) a plurality of vertically spaced hooks arrayed along an upright first-plane, each hook extending horizontally rearwardly and then downwardly from the arm rear-side whereby each hook is adapted to extend into and partially occupy the height of a vertically elongate aperture of a said multi-apertured column; and (C) a horizontally elongate lock located along said first-plane and at the arm rear-side, said lock having an elevation between consecutive bracket hooks and being horizontally reciprocatably associated with said arm so as to move along the horizontal portion of a said consecutive hook toward the unoccupied height remainder of a said partially occupied column aperture, and said lock having an inclined notchably serrated rear-end contour adapted to removably securely plug-into said column aperture unoccupied height remainder to thereby prevent upward dislodgement of said bracket from a said multi-apertured column.

2. The improved multi-hooks bracket of claim 1 wherein the arm along the upper-edge and rear-side lies along said upright first-plane and is singularly constructed of laminar structural material; wherein the central portion of said arm is singularly constructed of said same laminar structural material and lies along an upright second-plane that is directionally laterally offset from and substantially parallel to said first-plane; and wherein said arm central portion is in slidable relationship to said lock.

3. The improved multi-hooks bracket of claim 1 wherein the number of notched serrations at the lock inclined rear-end is at least two and not more than six in number.

4. The improved multi-hooks bracket of claim 3 wherein the hooks and the arm along the upper-edge and the rear-side lie along said upright first-plane and are singularly constructed of laminar metallic structural material; wherein the non-peripheral central portion of said arm is singularly constructed of said same laminar metallic structural material and lies along a second-plane that is directionally laterally offset from and substantially parallel to said first-plane; and wherein the lock is in horizontally slidable relationship with said arm central portion.

* * * * *